US009350072B2

(12) United States Patent
Park et al.

(10) Patent No.: US 9,350,072 B2
(45) Date of Patent: May 24, 2016

(54) ELECTRONIC APPARATUS FOR ISOLATING SIGNAL GENERATION DEVICE

(75) Inventors: Jiyong Park, Gwangmyeong-si (KR); Jungsik Park, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 495 days.

(21) Appl. No.: 13/600,708

(22) Filed: Aug. 31, 2012

(65) Prior Publication Data

US 2013/0120201 A1 May 16, 2013

(30) Foreign Application Priority Data

Nov. 14, 2011 (KR) ..... 10-2011-0118401

(51) Int. Cl.

| | |
|---|---|
| ***H01Q 1/38*** | (2006.01) |
| ***H01Q 1/48*** | (2006.01) |
| ***H01Q 1/52*** | (2006.01) |
| *H01Q 21/28* | (2006.01) |

(52) U.S. Cl.

CPC ..... *H01Q 1/48* (2013.01); *H01Q 1/521* (2013.01); *H01Q 21/28* (2013.01)

(58) Field of Classification Search

USPC ..... 343/700 MS, 702, 749

See application file for complete search history.

(56) References Cited

U.S. PATENT DOCUMENTS

| | | | | |
|---|---|---|---|---|
| 7,629,930 | B2 * | 12/2009 | Murch | H01Q 1/48 343/700 MS |
| 2010/0156745 | A1 * | 6/2010 | Andrenko | H01Q 1/38 343/848 |
| 2010/0238072 | A1 * | 9/2010 | Ayatollahi | H01Q 1/243 343/700 MS |

* cited by examiner

*Primary Examiner* — Hoang V Nguyen
*Assistant Examiner* — Hai Tran
(74) *Attorney, Agent, or Firm* — Jefferson IP Law, LLP

(57) ABSTRACT

An electronic apparatus is provided. The apparatus includes at least one signal generation device that generates a signal when power is supplied, a grounding plate in which a slot is formed, which grounds the signal generation device when the signal generation device is operated, and a blocking device interposed in the slot, which closes the slot, provides an output path of the signal, and blocks an inflow of the signal to the signal generation device when the signal generation device is operated.

12 Claims, 10 Drawing Sheets

ELECTRONIC APPARATUS FOR ISOLATING SIGNAL GENERATION DEVICE

PRIORITY

This application claims the benefit under 35 U.S.C. §119 (a) of a Korean patent application filed on Nov. 14, 2011 in the Korean Intellectual Property Office and assigned Serial No. 10-2011-0118401, the entire disclosure of which is hereby incorporated by reference.

BACKGROUND OF THE INVENTION

1. Field of the Invention

The present invention relates to an electronic apparatus. More particularly, the present invention relates to an electronic apparatus capable of isolating a signal generation device.

2. Description of the Related Art

Generally, various multimedia services such as a video, music and games, etc. are provided in a wireless communication system. When such a service is provided, a high-speed data processing rate for multimedia data of a large size should be secured in order to smoothly use the multimedia service in an electronic apparatus. To this end, research on improving performance of a signal generation device in an electronic apparatus is being conducted because a signal generation apparatus is substantially responsible for processing multimedia data. Such a signal generation device generates a signal according to the processing of multimedia data.

However, when the above signal generation device is operated, an electromagnetic mutual coupling may occur in the signal generation device, which is a problem. That is, a signal generated in the signal generation device is inputted or a signal generated in another signal generation device is inputted, and thereby the signal may be experienced as interference in the corresponding signal generation device. As electronic apparatuses become smaller, such a problem becomes correspondingly more serious, and causes deterioration of the performance of the electronic apparatuses.

SUMMARY OF THE INVENTION

Aspects of the present invention are to address at least the above-mentioned problems and/or disadvantages and to provide at least the advantages described below. Accordingly, an aspect of the present invention is to mitigate an electronic mutual coupling of a signal generation device in an electronic apparatus. In addition, another object of the present invention is to enable miniaturization of an electronic apparatus.

In accordance with an aspect of the present invention, an electronic apparatus is provided. The apparatus includes at least one signal generation device that generates a signal when power is supplied, a grounding plate in which a slot is formed, which grounds the signal generation device when the signal generation device is operated, and a blocking device interposed in the slot, which closes the slot, provides an output path of the signal, and blocks an inflow of the signal to the signal generation device when the signal generation device is operated.

According to an electronic apparatus of exemplary embodiments of the present invention, when a signal generation device is operated, since a closed resonant circuit is independently formed in a signal generation device along the blocking device and the surrounding area of a slot in a ground plate, a signal outputted from the signal generation device is outputted along the closed resonant circuit, and thereby, the signal outputted from the signal generation device is trapped in the closed resonant circuit and thus the signal is inhibited from being flowed into the signal generation device. As such, since the electromagnetic mutual coupling according to the signals outputted from the signal generation device is restricted, a signal generation device is efficiently isolated in an electromagnetic apparatus. As such, the miniaturization of an electronic apparatus can be implemented.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
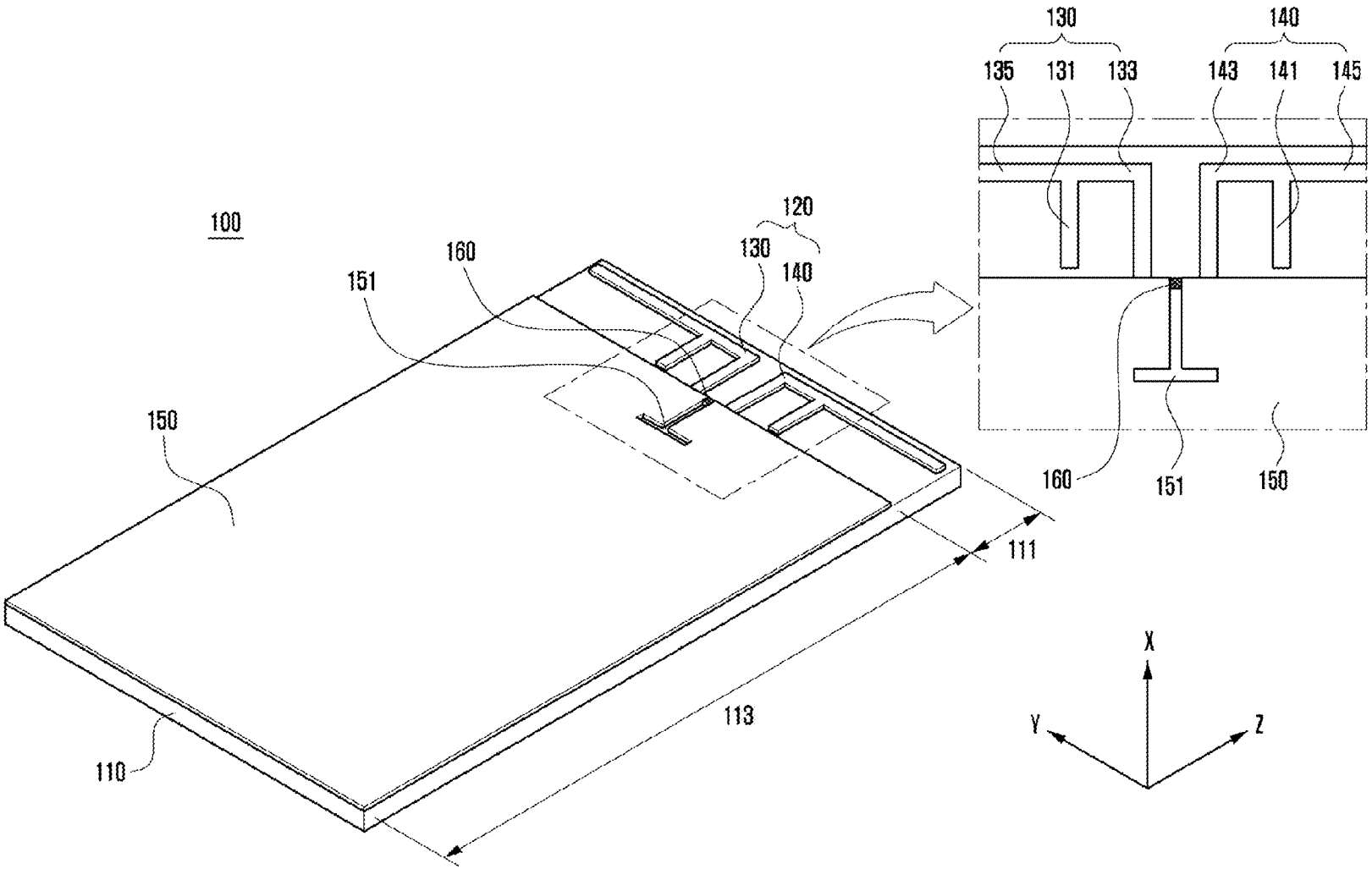
FIG. 1 is a perspective view illustrating an electronic apparatus according to a first exemplary embodiment of the present invention.
Figure 2:
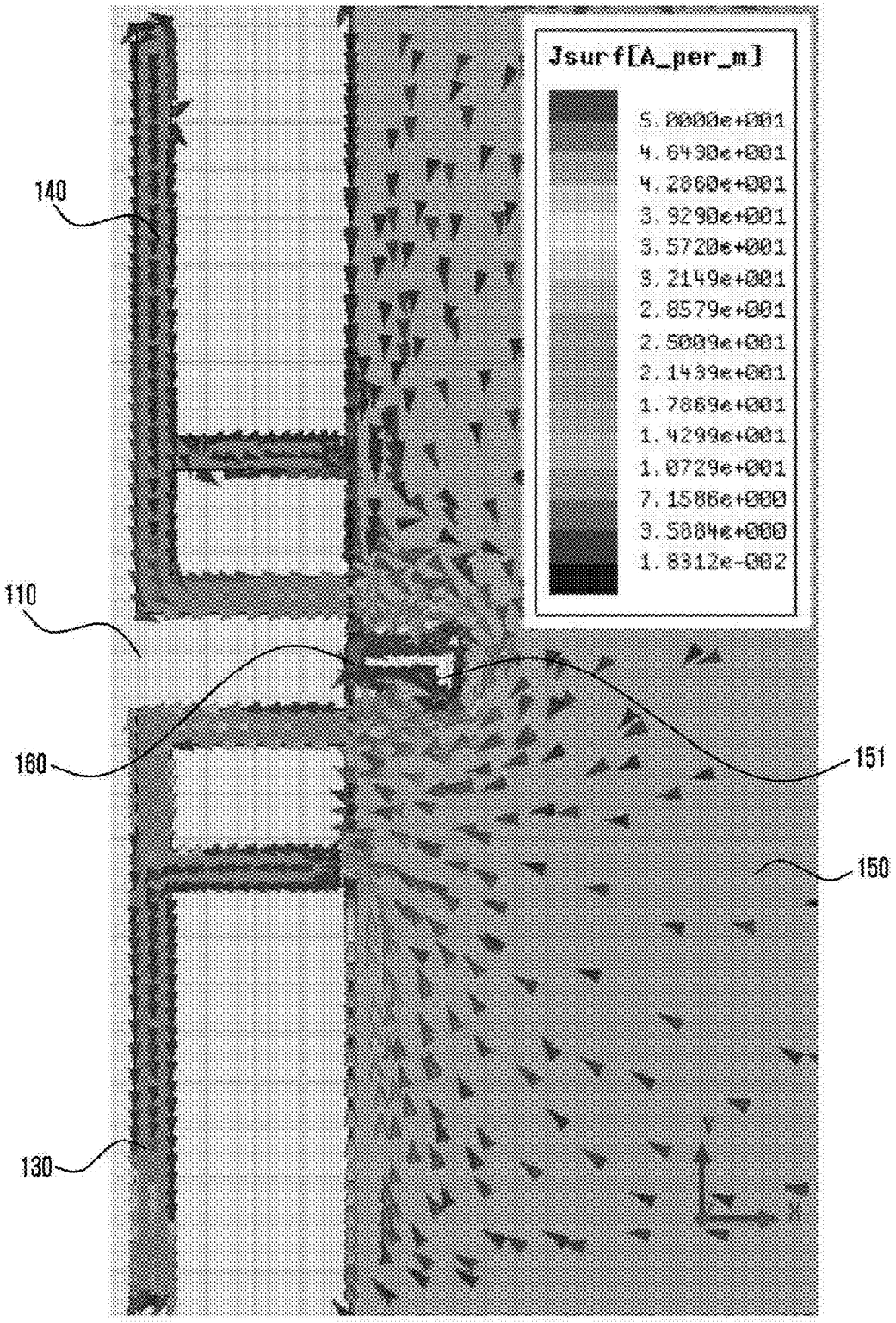
FIG. 2 illustrates current distribution according to operation of a signal generation device in an electronic apparatus according to the first exemplary embodiment of the present invention.
Figure 3:
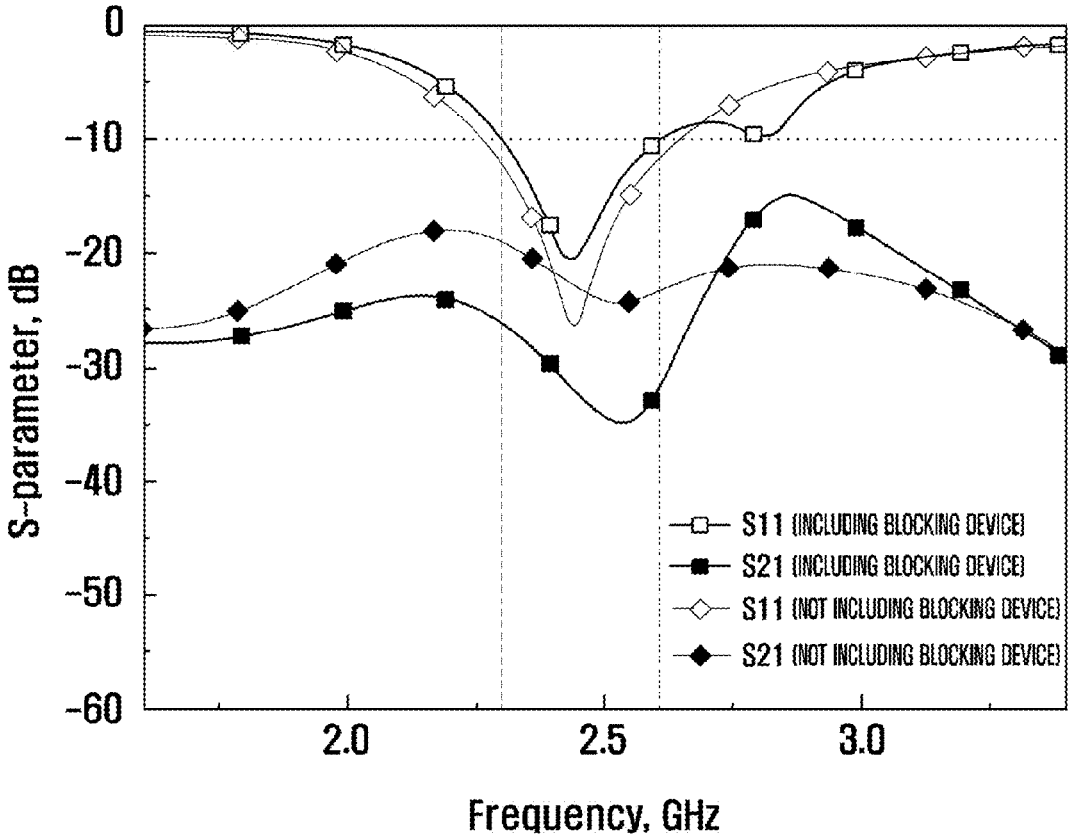
FIG. 3 is a graph illustrating a change of parameter S according to operation of a signal generation device in an electronic apparatus according to the first exemplary embodiment of the present invention.

FIG. 1 is a perspective view illustrating an electronic apparatus according to a first exemplary embodiment of the present invention. Further, FIG. 2 illustrates current distribution according to operation of a signal generation device in an electronic apparatus according to the first exemplary embodiment of the present invention. Further, FIG. 3 is a graph illustrating a change of parameter S according to operation of a signal generation device in an electronic apparatus according to the first exemplary embodiment of the present invention.

Referring to FIG. 1, an electronic apparatus 100 according to the first exemplary embodiment includes a main board 110, a signal generation device 120, a ground plate 150 and a blocking device 160. Here, it is assumed that the electronic apparatus 100 is a Multiple-Input Multiple Output (MIMO) antenna apparatus.

The main board 110 is provided for support and power supply in electronic apparatus 100. Such a main board 110 can be a Printed Circuit Board (PCB). That is, the main board 110 may be implemented in a flat plate structure. Further, one side of the main board 110, e.g., the upper side in an X-axis direction, is divided into a device area 111 and a ground area 113. Further, the main board 110 comprises a dielectric including multiple power supply lines (not shown). Here, the main board 110 can be implemented in a manner such that multiple dielectric plates are stacked in the X-axis direction. At this time, each power supply line is exposed to the outside through both ends. Here, one end of the power supply line is connected to an external power source (not shown). Further, the other end of the power supply line is exposed to the outside through the device area 111, and thereby, when power is supplied from an external power source through one end, the power supply line supplies power to the other end. Here, power can be restrictively supplied to at least one of the power supply lines.

The signal generation device 120 is provided for the processing of multimedia data in the electronic apparatus 100. Such a signal generation device 120 generates a signal according to the processing of multimedia data. At this time, the signal generation device 120 can be antenna devices 130 and 140 for transmitting and receiving an electromagnetic wave by resonating in at least one frequency band according to an exemplary embodiment of the present invention.

Such antenna devices 130 and 140 are electrically connected to the power supply line of the main board 110, through which power can be supplied from the power supply line of the main board 110 to the antenna devices 130 and 140. Further, the antenna devices 130 and 140 are disposed away from each other in the device area 111 of the main board 110. At this time, the antenna devices 130 and 140 can be implemented in a mutually symmetrical form or in a mutually asymmetrical form. Further, the antenna devices 130 and 140 are implemented as a transmission line type of conductive material and construction. At this time, the antenna devices 130 and 140 are patterned and formed in the device area 111 of the main board 110. Further, each antenna device 130 and 140 is formed in a structure where at least one folded part is formed. Here, each antenna device 130 and 140 can be formed at least in one of a meander type, a spiral type, a step type, a loop type, etc.

For example, each antenna device 130 and 140 can be implemented in a Planar Inverted F Antenna (PIFA) structure. At this time, each antenna device 130 and 140 comprises a feeding part 131 and 141, a grounding part 133 and 143, and an open part 135 and 145. The feeding part 131 and 141 is connected to the power supply line through one end in the device area 111 of the main board 110, and is extended through the other end. The grounding part 133 and 143 is connected to the other end of the feeding part 131 and 141 through one end, and is connected to the grounding plate 150 through the other end. The open part 135 and 145 is connected to the other end of the feeding part 131 and 141 through one end, and is opened through the other end. That is, the PIFA structure is implemented as the feeding part 131 and 141, the grounding part 133 and 143 and the open part 135 and 145 are mutually combined in each antenna device 130 and 140. Further, when power is supplied through the power supply line, the feeding part supplies power to the grounding part 133 and 143 and the open part 135 and 145. Here, power may be supplied restrictively to at least one of the antenna devices 130 and 140.

The grounding plate 150 is provided for the grounding of the signal generation device 120 in the electronic apparatus 100. That is, when operating the signal generation device 120, the grounding plate 150 grounds the signal generation device 120. Such a ground plate 150 is disposed in the ground area 113 of the main board 110. At this time, the grounding plate 150 has a planar structure. Here, the grounding plate 150 can be disposed horizontally on one side of the main board 110, for example, in a Y-axis direction and a Z-axis direction, to cover the entire area of the ground area 113. Further, the grounding plate 150 can be disposed vertically to one side of the main board 110, for example, in the X-axis direction, in part of the ground area 113.

Further, the grounding plate 150 is implemented in a structure where a slot 151 is formed between antenna devices 130 and 140. At this time, in the grounding plate 150, a slot 151 is formed at a position adjacent to at least one of the feeding part 131 and 141 and the grounding part 133 and 143 of the antennas 130 and 140. Further, the slot is introduced from the edge area of the grounding plate 150, and is opened through the edge area of the grounding plate 150. Further, the slot 151 is formed in a T shape. That is, the slot 151 is extended from the edge area to an internal area, and is formed in a shape that diverges in a middle part.

The blocking device 160 is provided to isolate the signal generation device 120 in the electronic apparatus 100. Such a blocking device 160 is interposed in the slot of the grounding plate 150 in the ground area 113 of the main board 110. At this time, the blocking device 160 comprises at least one of an active element and a passive element. Here, the active element includes at least one of a transistor, an amplifier, and an oscillator. Further, the passive device includes at least one of a resistor, a capacitor, an inductor and a transformer. Further, when operating the signal generation device 120, the signal generation device 120 is isolated as the blocking device 160 operates with the slot 151.

That is, when the signal generation device 120 is not operated, the blocking device 160 opens the slot 151. In other words, the blocking device 160 opens the slot in a frequency band, which is different from the frequency band of the signal generation device 120. Further, when the signal generation device 120 is operated, the blocking device 160 closes the slot 151. Here, the blocking device 160 closes the slot in a frequency band of the signal generation device 120. At this time, a closed resonant circuit is formed independently from the signal generation device 120 along the surrounding area of the slot 151 and the blocking device 160 in the grounding plate 150.

Through the above process, when the signal generation device 120 is operated, a signal, which is outputted from the signal generation device 120, is outputted along the closed resonant circuit in the grounding plate 150, as illustrated in FIG. 2. In other words, the blocking device 160 forms a closed resonant circuit along with the slot 151, which is provided as an outputting passage for a signal outputted from the signal generation device 120, and thereby a signal outputted from the signal generation device is trapped in the closed resonant circuit, and thus the signal is inhibited from flowing into the signal generation device 120. As such, as the blocking device 160 forms a closed resonant circuit along with the slot 151, and thus reference numeral S21 corresponding to interference between antenna devices 130 and 140 rapidly decreases in a frequency band where reference numeral S11 corresponding to the resonance of antenna devices 130 and 140 rapidly decreases, as illustrated in FIG. 3. That is, interference within each antenna device 130 and 140 and interference between antenna devices 130 and 140 are restricted.

Figure 4:
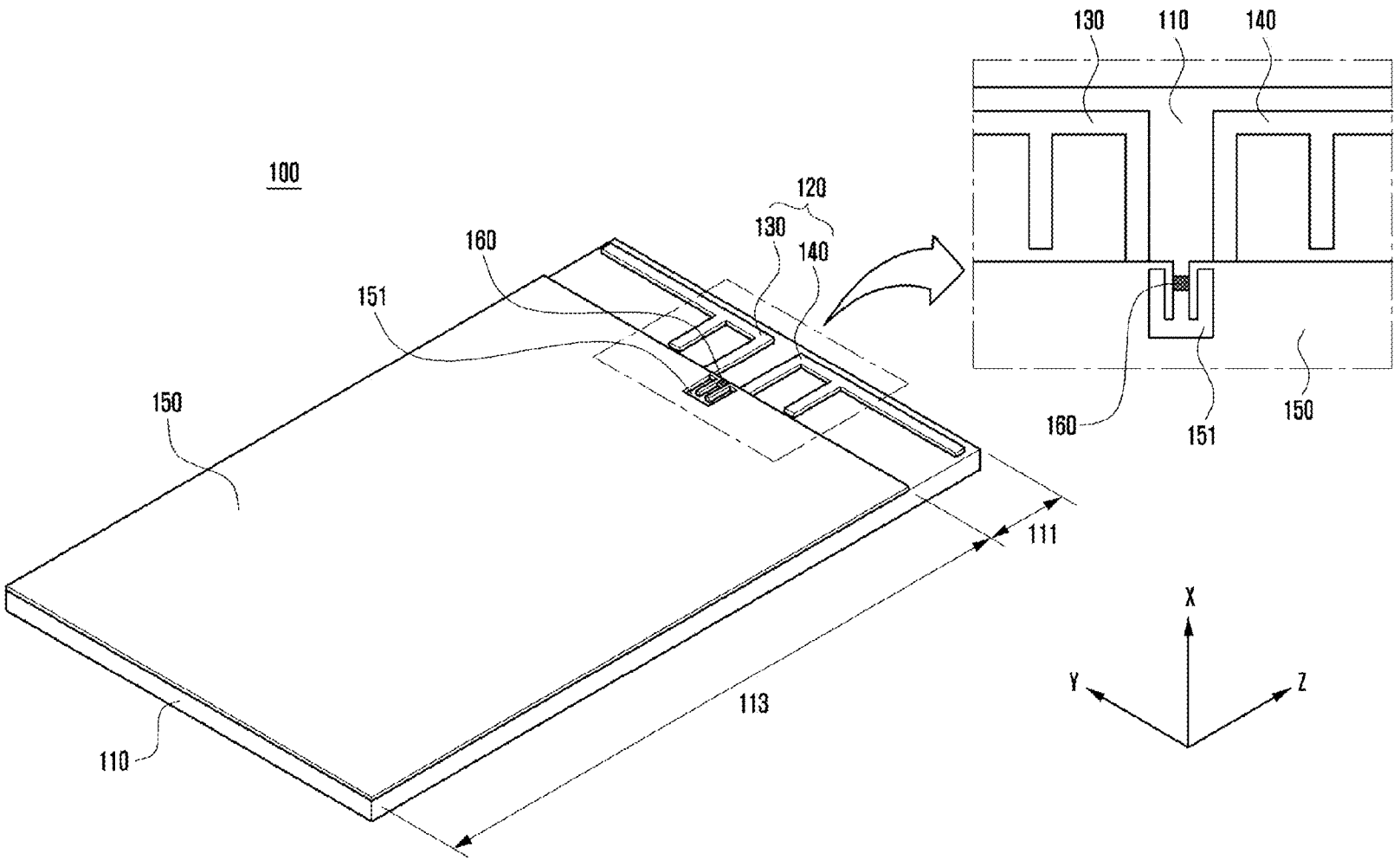
FIGS. 4 to 6 illustrate modified examples of an electronic apparatus according to the first exemplary embodiment of the present invention.
Figure 5:
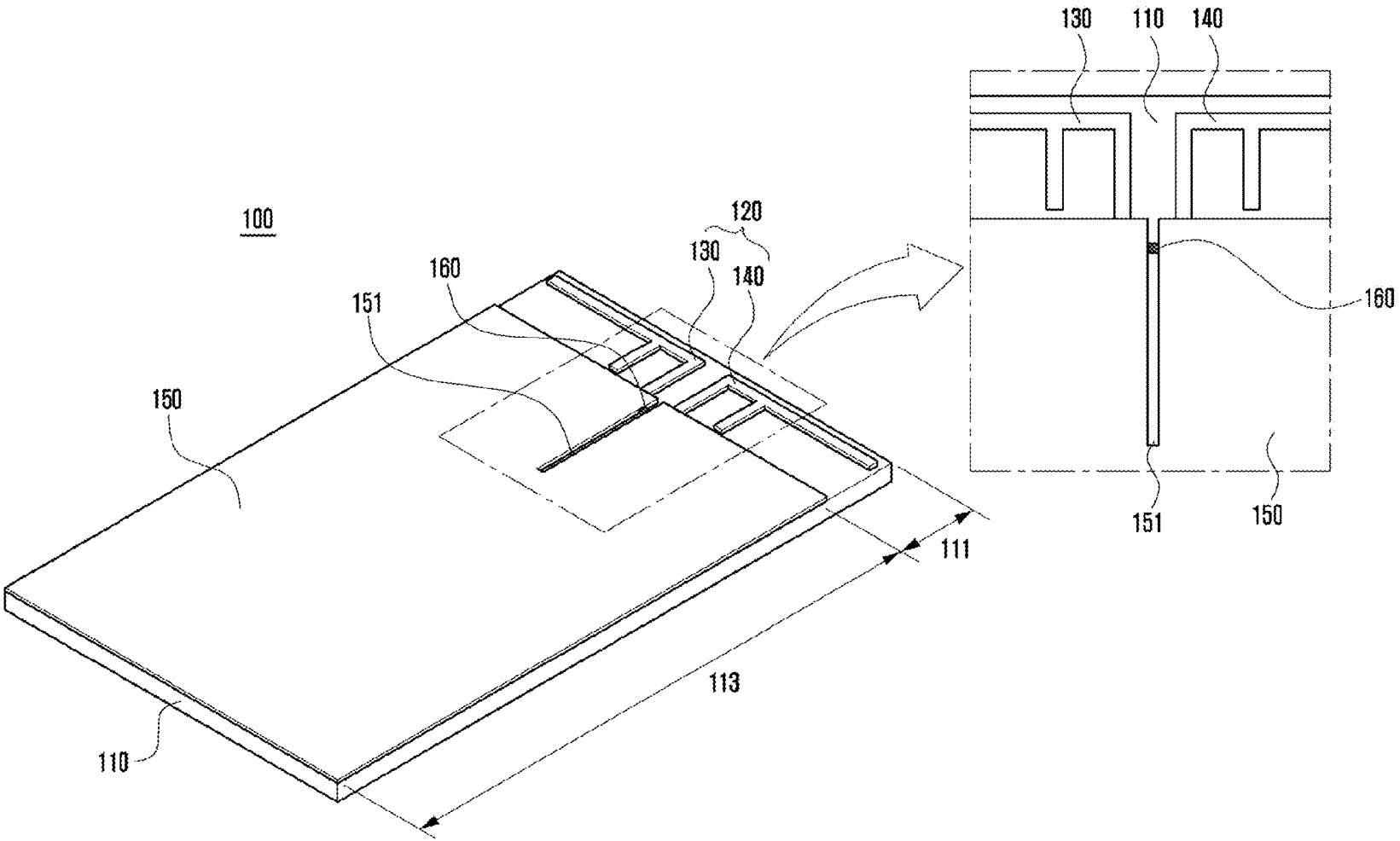
Figure 6:
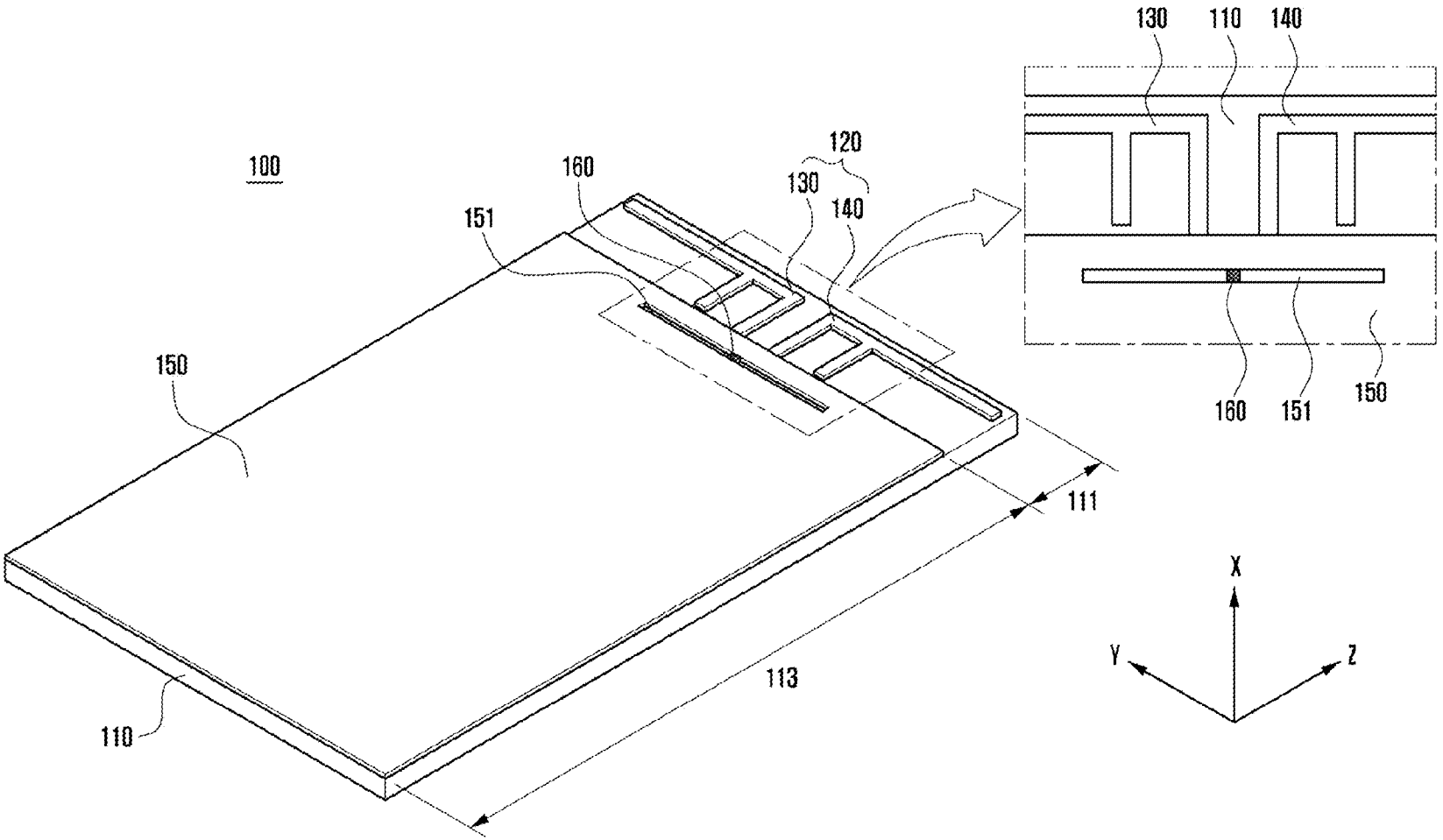

Further, the present exemplary embodiment discloses an example where the slot 151 of the grounding plate 150 is formed in a T shape, but the present invention is not limited to this example. Further, the present exemplary embodiment discloses an example where the slot 151 of the grounding plate 150 is opened through the edge area of the grounding plate 150, but the present invention is not limited to this example. That is, in the grounding plate 150, a slot can be formed in various shapes. FIGS. 4 to 6 include such examples, and are perspective views illustrating modified examples of an electronic apparatus according to the first exemplary embodiment of the present invention.

That is, in the present exemplary embodiment, the slot 151 of the grounding plate 150 can be introduced from the edge area of the grounding plate 150, and can be opened through the edge area of the grounding plate 150. Further, in the grounding plate 150, the slot 151 can be formed in a folded T-shape, as illustrated in FIG. 4. In other words, the slot 151 is extended to the internal area in the edge area of the grounding plate 150, and can be formed in a diverged and folded shape. Further, in the grounding plate 150, the slot can be formed in a bar shape, as illustrated in FIG. 5. In other words, the slot 151 can be formed by being extended in a straight line without being folded into the internal area in the edge area of the grounding plate 150. Further, in the present exemplary embodiment, the slot 151 of the grounding plate 150 can be implemented in a closed structure by the grounding plate 150 by being formed at the internal area of the grounding plate 150, as illustrated in FIG. 6. Further, in the grounding plate 150, the slot can be formed in a bar shape. In other words, the slot 151 can be formed by being extended in a straight line without being folded in the internal area of the grounding plate 150.

Figure 7:
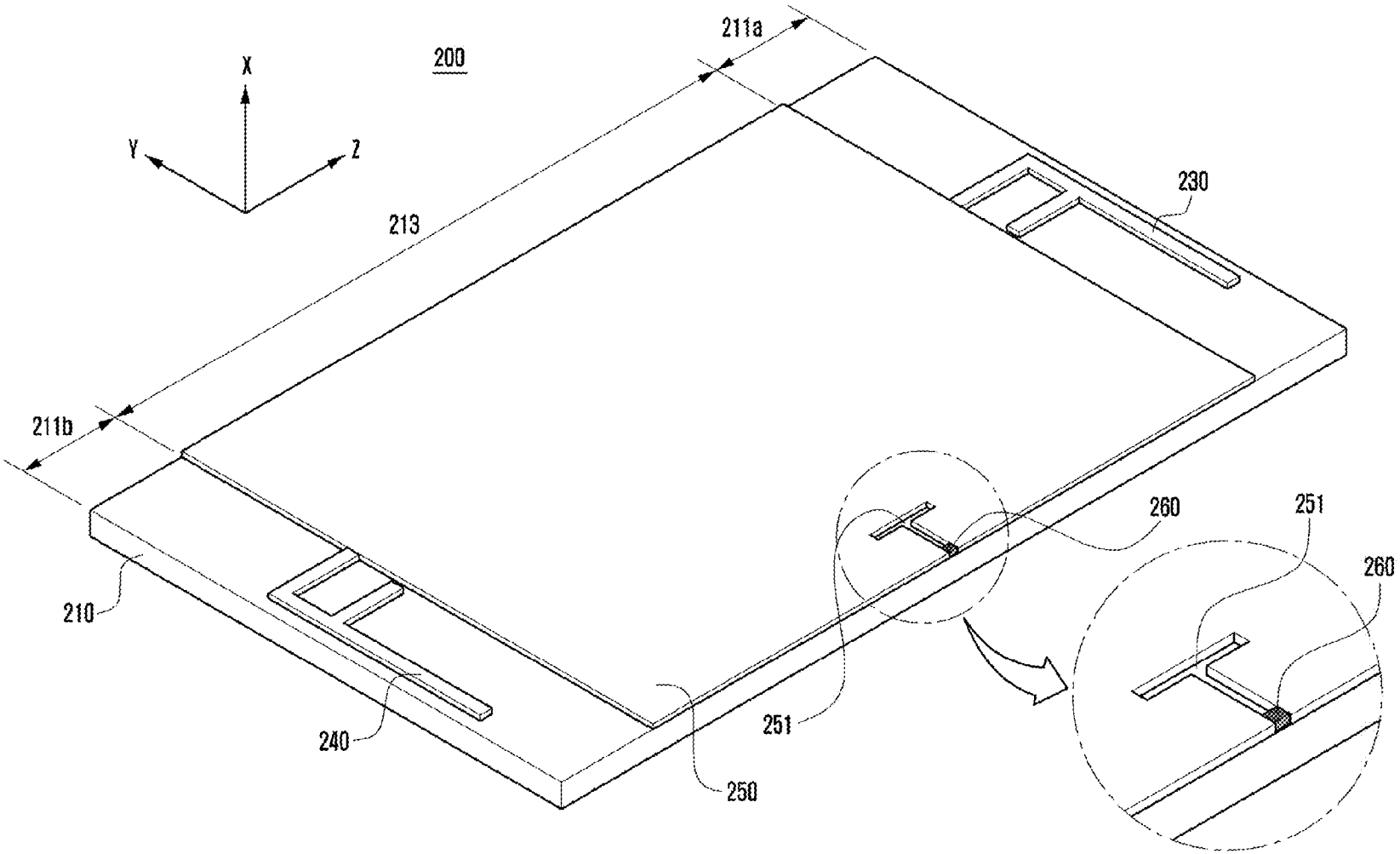
FIG. 7 is a perspective view illustrating an electronic apparatus according to a second exemplary embodiment of the present invention.

FIG. 7 is a perspective view illustrating an electronic apparatus according to a second exemplary embodiment of the present invention.

Referring to FIG. 7, an electronic apparatus 200 according to the second exemplary embodiment includes a main board 210, a signal generation device, that is, antenna devices 230 and 240, a grounding plate 250 and a blocking device 260. Here, the main board 210, the signal generation device, that is, antenna devices 230 and 240, the grounding plate 250 and the blocking device 260 of the present exemplary embodiment are constituted in a manner that is similar to that in the previous exemplary embodiment, and thus a detailed description thereof is omitted herein for brevity. However, in the present exemplary embodiment, the signal generation device, that is, antenna devices 230 and 240 are disposed away from each other with the grounding plate 250 as the boundary.

That is, one side of the main board 210, e.g., the upper side in an X-axis direction, is divided into device areas 211A and 211B and a ground area 213. At this time, in the main board 210, the device areas 211*a* and 211*b* are disposed away from each other with the ground area 213 as the center. Further, the signal generation device, that is, antenna devices 230 and 240, are divided and disposed in the device areas 211A and 211B, through which the antenna devices 230 and 240 are disposed away from each other with the ground area 213 as a medium. Further, the grounding plate 250 is disposed between the antenna devices 230 and 240 in the ground area 213. At this time, the grounding plate 250 is implemented in a structure where a slot 251 is formed between the antenna devices 230 and 240. Further, the blocking device 260 is interposed in the slot of the grounding plate 250 in the ground area 213. As such, when the antenna devices 230 and 240 are operated, the blocking device 260 isolates antenna devices 230 and 240 by operating with the slot 251.

Figure 8:
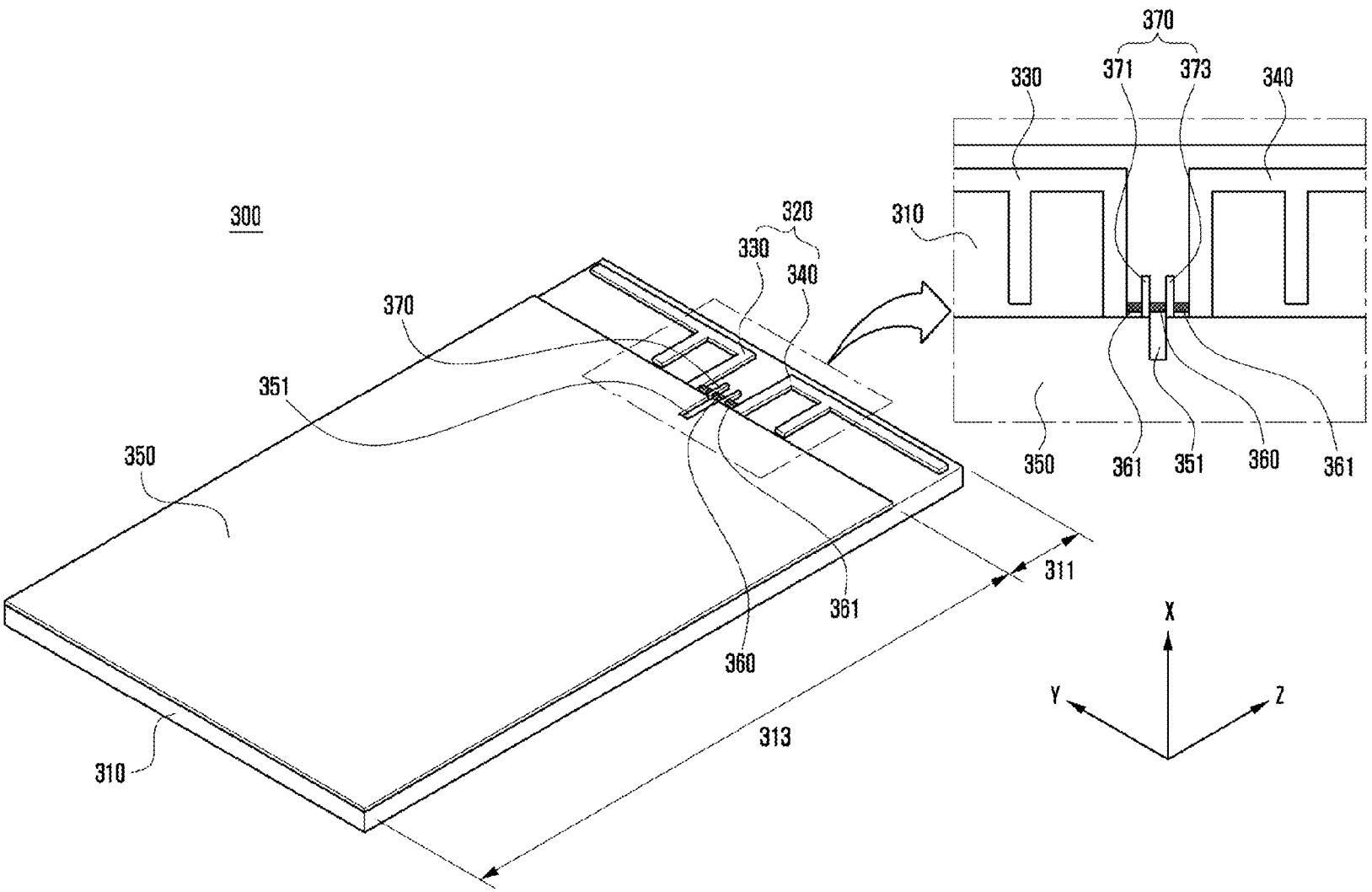
FIG. 8 is a perspective view illustrating an electronic apparatus according to a third exemplary embodiment of the present invention.

FIG. 8 is a perspective view illustrating an electronic apparatus according to a third exemplary embodiment of the present invention.

Referring to FIG. 8, an electronic apparatus 300 according to the third exemplary embodiment includes a main board 310, a signal generation device 320, a grounding plate 350, a blocking device 360, and a stub 370. In the present exemplary embodiment, the main board 310, the signal generation device 320, the grounding plate 350 and the blocking device 360 are constituted in a manner that is similar to that of the previous exemplary embodiments, and thus a detailed description thereof are omitted herein for brevity. However, the electronic apparatus 300 of the present exemplary embodiment further includes the stub 370.

The stub 370 is provided to extend slot 351 of the grounding plate 350 in the electronic apparatus 300. Such a stub 370 is disposed in the device area 311 of the main board 310. Further, the stub 370 is disposed between the signal generation device 320, i.e., antenna devices 330 and 340, in the device area 311 of the main board 310. Here, the grounding plate 350 is disposed in the ground area 313 of the main board 310. Further, in the grounding plate 350, the slot 351 is introduced from the edge area corresponding to the device area 311 of the main board 310, and is opened through the edge area of the grounding plate 350. Further, the stub 370 may comprise at least two pieces 371 and 373 in the present exemplary embodiment. Such pieces 371 and 373 are mounted away from each other at both ends of the slot 351 in the edge area of the grounding plate 350, and extend the path for introducing the slot 351 to the grounding plate 350. Here, the slot 351 of the grounding plate 350 is opened in the device area 311 of the main board 310 through the pieces 371 and 373.

Further, the blocking device 360 is mounted on the stub 370 in the device area 311 of the main board 310. At this time, the blocking device 360 is interposed between the pieces 371 and 373 of the stub 370. That is, the blocking device 360 is interposed in the path where the slot 351 of the grounding plate 350 is extended, and thereby, when antenna devices 330 and 340 are operated, the blocking device 360 is operated with the slot to isolate the antenna devices 330 and 340. Further, the blocking device 360 can include a sub-blocking device 361. The sub-blocking device 361 is interposed between the signal generation device 320 and the stub 370 in the device area 311 of the main board 310. Here, the sub-blocking device 361 can be interposed in at least one of the spaces formed between the antenna devices 330 and 340 and pieces 371 and 373. Such a sub-blocking device 361 is provided for supplementing performance of the blocking device 360, and isolates antenna devices 330 and 340 in response to the operation of the blocking device 360.

Figure 9:
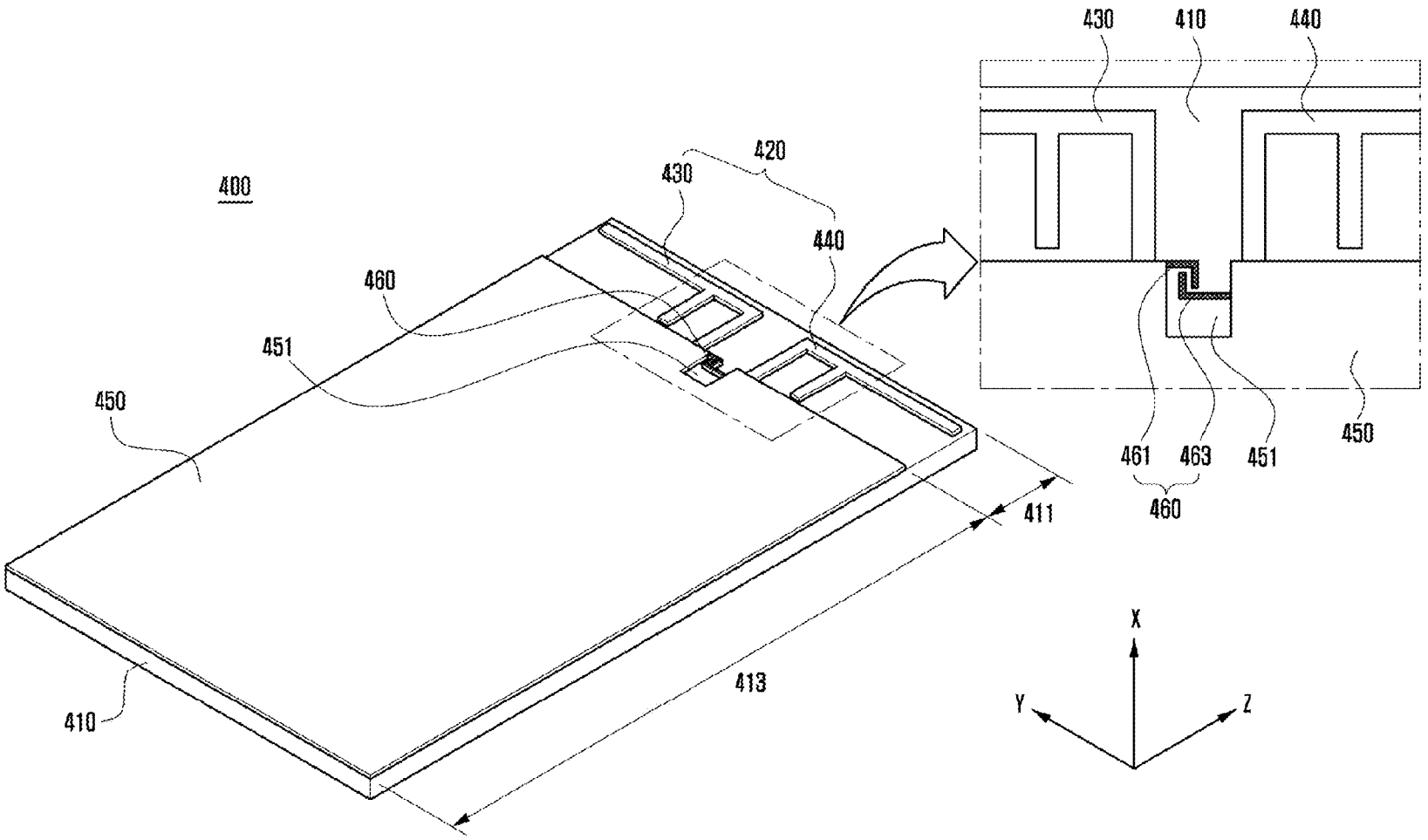
FIG. 9 is a perspective view illustrating an electronic apparatus according to a fourth exemplary embodiment of the present invention.

FIG. 9 is a perspective view illustrating an electronic apparatus according to a fourth exemplary embodiment of the present invention.

Referring to FIG. 9, an electronic apparatus 400 according to the fourth exemplary embodiment includes a main board 410, a signal generation device 420, a grounding plate 450, and a blocking device 460. In the present exemplary embodiment, the main board 410, the signal generation device 420, the grounding plate 450 and the blocking device 460 are constituted in a manner that is similar to that of the previous exemplary embodiments, and thus a detailed description thereof are omitted herein for brevity. However, in the present exemplary embodiment, the blocking device 460 is implemented as a transmission line type of a cap type.

That is, the blocking device 460 comprises at least two circuit patterns 461 and 463. The circuit patterns 461 and 463 are implemented in a transmission line type of conductive material and construction. At this time, the circuit patterns 461 and 463 are formed in a structure where at least one folded part is formed. Such circuit patterns 461 and 463 are printed in a slot 451 of the grounding plate 450 in the grounding area 413 of the main board 410. At this time, the circuit patterns 461 and 463 are extended from the boundary part formed by the slot 451 in the grounding plate 450 to the slot 451. Here, the circuit patterns 461 and 463 are extended in a direction that is opposite to each other, and is overlapped while maintaining regular intervals, through which, when the signal generation device 420, i.e., the antenna devices 430 and 440, are operated in the device area 411 of the main board 410, an electromagnetic field is formed between the circuit patterns 461 and 463. As such, the circuit patterns 461 and 463 isolate the antenna devices 430 and 440 by being operated with the slot 451.

Figure 10:
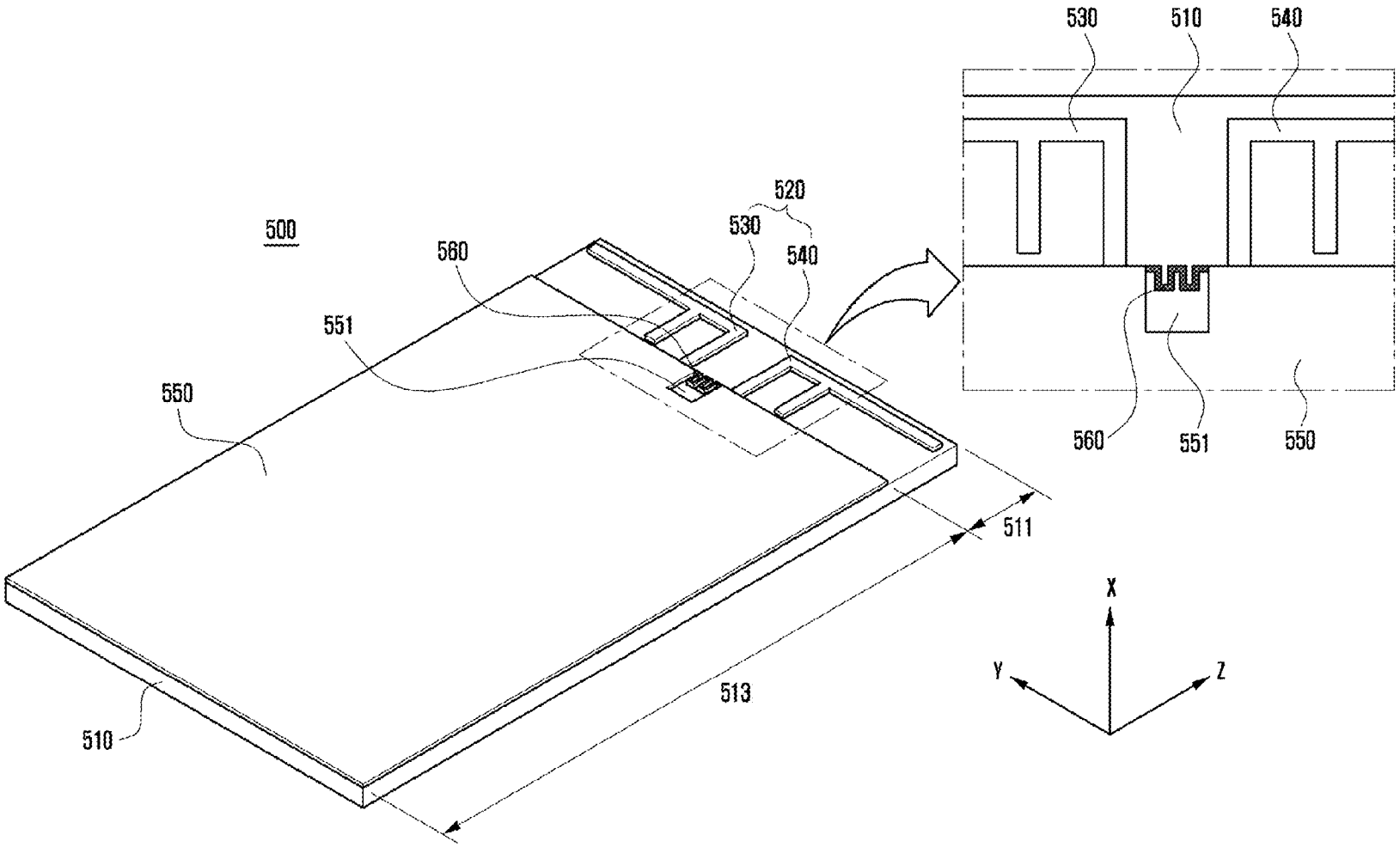
FIG. 10 is a perspective view illustrating an electronic apparatus according to a fifth exemplary embodiment of the present invention.

FIG. 10 is a perspective view illustrating an electronic apparatus according to a fifth exemplary embodiment of the present invention.

Referring to FIG. 10, an electronic apparatus 500 of the fifth exemplary embodiment includes a main board 510, a signal generation device 520, a grounding plate 550 and a blocking device 560. In the present exemplary embodiment, the main board 510, the signal generation device 520, the grounding plate 550 and the blocking device 560 are constituted in a manner that is similar to that of the previous exemplary embodiments, and thus a detailed description thereof is omitted herein for brevity. However, in the present exemplary embodiment, the blocking device 560 is implemented as a transmission line type of a meander type.

That is, the blocking device 560 is formed in a single circuit pattern. In other words, the blocking device 560 is implemented in a transmission line type of conductive material and construction. At this time, the blocking device 560 is formed in a meander shape where multiple folded parts are formed. Such a blocking device 560 is printed in the slot 551 of the grounding plate 550 in the grounding area 513 of the main board 510. At this time, the blocking device 560 connects the surrounding area formed by the slot 551 in the grounding plate 550. Here, the blocking device 560 is extended to cross the slot 551, through which, when the signal generation device 520, i.e., the antenna devices 530 and 540 are operated in the device area 511 of the main board 510, an electromagnetic field is formed in the blocking device 560. As such, the blocking device 560 isolates the antenna devices 530 and 540 by being operated with the slot 561.

Further, an example of implementing the blocking device 560 in a transmission line type of a meander type was disclosed in the present exemplary embodiment, but the present invention is not limited to this example. That is, the blocking device 560 can be implemented in various forms of transmission line types. For example, the blocking device 560 can be formed in at least one of a meander type, a spiral type, a step type and a roof type.

Further, in the previous exemplary embodiments, it has been explained that the antenna devices are printed and formed in the device area of the main board, but the present invention is not limited to this example. That is, even if the antenna devices are printed and formed in the carrier of dielectric materials, the present invention can be implemented. At this time, the carrier can be mounted in the device area of the main board.

Further, in the present exemplary embodiments, it has been explained that the signal generation device includes antenna devices, but the present invention is not limited to this example. That is, even if the signal generation device is an integrated circuit device, the present invention can be implemented. For example, the integrated circuit device may include a semiconductor chip and a Flexible Printed Circuit Board (FPCB).

According to the exemplary embodiments of the present invention, when the signal generation device is operated, a closed resonant circuit is independently formed in the signal generation device along the surrounding area of the slot and the blocking device in the grounding plate, and thus the signal outputted from the signal generation device is outputted along the closed resonant circuit. As such, the signal outputted from the signal generation device is trapped, and the signal is prevented from flowing into the signal generation device. As such, since an electromagnetic mutual coupling according to the signal outputted in the signal generation device is inhibited, the signal generation device is efficiently isolated in the electronic apparatus. As such, miniaturization of an electronic apparatus can be implemented.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An electronic apparatus, the apparatus comprising:

a main board divided into a device area and a ground area;

at least one signal generation device that generates a signal when power is supplied, the signal generation device comprising antenna devices disposed away from each other in the device area of the main board;

a grounding plate in which a slot is disposed between the antenna devices and formed with at least one end opened, wherein the grounding plate grounds the signal generation device when the signal generation device is operated, is disposed horizontally on a side of the main board to cover the entire area of the ground area of the main board and vertically to the side of the main board in part of the ground area; and a blocking device including a circuit pattern printed and interposed in the slot, which closes the slot, provides an output path of the signal, and blocks an inflow of the signal to the signal generation device when the signal generation device is operated, wherein, when the signal generation device is operated, a closed resonant circuit is formed in the signal generation device along the blocking device and a surrounding area of the slot in the grounding plate.

2. The apparatus of claim 1, wherein the blocking device is one of an active device and a passive device.

3. The apparatus of claim 1, wherein the blocking device closes the slot in a frequency band where the signal generation devices is operated, and opens the slot in other frequency bands.

4. The apparatus of claim 3, wherein the slot is formed in a position adjacent to one of a feeding part where power is supplied and a grounding part for grounding to the grounding part in the signal generation device.

5. The apparatus of claim 3, wherein the signal generation device is in an integrated circuit device.

6. The apparatus of claim 1, wherein the circuit pattern comprises at least one folded part.

7. The apparatus of claim 6, wherein the circuit pattern is formed as at least one of a cap type, a meander type, a spiral type, a step type and a roof type.

8. The apparatus of claim 1, further comprising:

a stub that is disposed in the device area of the main board and connected to the grounding plate and extends the slot.

9. The apparatus of claim 8, wherein the blocking device is connected to the stub.

10. The apparatus of claim 1, wherein the antenna device comprises a circuit pattern comprising at least one folded part.

11. The apparatus of claim 10, wherein the antenna device is formed as at least one of a meander type, a spiral type, a step type and a roof type.

12. The apparatus of claim 1, wherein the slot is disclosed between two portions of the signal generation device.

* * * * *